US012415658B2

(12) United States Patent
Kettner

(10) Patent No.: US 12,415,658 B2
(45) **Date of Patent: *Sep. 16, 2025**

(54) OVERCAP WITH METHOD AND SYSTEM FOR MAKING THE SAME

(71) Applicant: Sonoco Development, Inc., Hartsville, SC (US)

(72) Inventor: Felix Kettner, Hockenheim (DE)

(73) Assignee: Sonoco Development, Inc., Hartsville, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/368,684

(22) Filed: Sep. 15, 2023

(65) Prior Publication Data

US 2024/0002108 A1 Jan. 4, 2024

Related U.S. Application Data

(63) Continuation of application No. 17/749,522, filed on May 20, 2022, now Pat. No. 11,794,958.

(51) Int. Cl.
*B65D 43/02* (2006.01)

(52) U.S. Cl.
CPC ..... *B65D 43/0212* (2013.01); *B65D 2543/00092* (2013.01); *B65D 2543/00268* (2013.01); *B65D 2543/00796* (2013.01)

(58) Field of Classification Search
CPC .. B65D 2543/0075; B65D 2543/00268; B65D 43/0212
See application file for complete search history.

(56) References Cited

U.S. PATENT DOCUMENTS

| | | | | |
|---|---|---|---|---|
| 2007/0090121 | A1 | 4/2007 | Harp et al. | |
| 2014/0224822 | A1 | 8/2014 | Song | |
| 2021/0237945 | A1* | 8/2021 | Tanaka | B65D 43/0218 |
| 2022/0112004 | A1 | 4/2022 | Hartinger et al. | |

FOREIGN PATENT DOCUMENTS

| | | | |
|---|---|---|---|
| DE | 4337176 | A1 | 5/1995 |
| WO | 2010111237 | A1 | 9/2010 |

OTHER PUBLICATIONS

International of Search Report and Written Opinion for International application No. PCT/US2023/014567; dated Jun. 2, 2023; 13 pages.

* cited by examiner

*Primary Examiner* — Jeffrey R Allen
(74) *Attorney, Agent, or Firm* — Nelson Mullins Riley & Scarborough LLP

(57) ABSTRACT

A one-piece paper lid and container system using the one-piece paper lid is provided herein. The one-piece paper lid comprises base having a central portion and peripheral portion, and a circumferential bead disposed adjacent the peripheral portion of the base. The circumferential bead is radially extendable between an inward position defining a first inner diameter and an outward position defining a second inner diameter. The one-piece paper lid further comprises a skirt extending downward from the circumferential bead. The skirt comprises an outer sidewall, an inner sidewall and an upwardly extending curl connecting the outer sidewall and the inner sidewall, wherein the inner sidewall comprises an inner protrusion extending radially inward.

12 Claims, 14 Drawing Sheets

OVERCAP WITH METHOD AND SYSTEM FOR MAKING THE SAME

CROSS-REFERENCE TO RELATED APPLICATIONS

This application is the continuation of U.S. Non-Provisional application Ser. No. 17/749,522, filed May 20, 2022, entitled "OVERCAP WITH METHOD FOR MAKING THE SAME," which is incorporated by reference in its entirety herein.

FIELD OF THE DISCLOSURE

The present disclosure relates to container closures, particularly to one-piece, paper-based container closures, and most particularly to overcap closures that provide a reclosable fit over an open end of a container.

BACKGROUND OF THE DISCLOSURE

Rigid, paper-based, composite container assemblies are often used to package various products, such as snacks and other food items, for example. These container assemblies often comprise a rigid container body (e.g., cylindrical) manufactured with the top and bottom ends open. The composite container bodies may comprise rigid cans made from sheet material (e.g., spirally wound), such as cardboard and/or paperboard. Such container assemblies further include top and bottom end closures. While the bottom end closure (e.g., metal or paper end) is usually permanently affixed (e.g., seamed) to a bottom rim of the container body, the top end closure is often designed to be easily removed by the consumer (e.g., a plastic removable/replaceable overcap and/or a peelable membrane). Typically, the membrane is first sealed to the top rim of the container. The container interior is then filled with products (e.g. food products) through the open bottom end of the container body, and the metal or paper closure is affixed onto the bottom rim of the container body. In a conventional container, the plastic overcap may be applied after sealing of the membrane and/or after affixing the bottom closure onto the container.

One disadvantage to the above-described conventional system is that the plastic removable/replaceable overcap may utilize polymers or polymer blends which are not readily recyclable in a common stream (e.g., curbside). Likewise, if a consumer fails to remove the plastic overcap from the container body prior to placing it in the recycling stream, the combined container/overcap may not be recyclable. Therefore, there is a need for a container assembly and overcap which is more easily recyclable, preferably using paper-based materials.

Existing paper overcaps are often used for drinking cups, ice cream tubs, yogurt containers, oatmeal containers, cheese containers for cheeses such as brie, dry soups, and the like. Paper overcaps are typically formed using a deep draw process which inherently causes the formation of wrinkles on the skirt of the lid. The wrinkles may limit printing and labeling applications and/or provide a product that is less visually appealing to the consumer that may be accustomed to smooth plastic overcaps. Accordingly, reducing the number of, appearance of, and/or feel of the skirt wrinkles is desirable.

Additionally, existing methods of making paper overcaps do not provide an acceptably tight fit or seal with their accompanying containers, do not allow repeated reclosures while maintaining the tight fit, and/or the natural expansion of the paper composition allows the overcap to become loose during repeated use. Still further, other existing paper overcaps are made from multiple paper components which are adhered together (i.e. not made from a single paper-based blank). Disadvantageously, the adhesives used may not be recyclable in the normal stream. Finally, the manufacture of such multi-component overcaps becomes more complicated, requires additional equipment, is time consuming, has a greater possibility for manufacturing defects due to the joining process, and is generally more expensive.

Through ingenuity and hard work, the inventors have developed systems and methods for making paper overcaps which are recyclable in a curbside stream, retain a tight fit or seal around an open end of a container end, even with multiple reseals, are easier and less expensive to manufacture, and provide an aesthetically pleasing skirt with fewer or less noticeable wrinkles.

BRIEF SUMMARY OF THE DISCLOSURE

The present disclosure relates generally to paper-based, one-piece overcaps and methods of making such overcaps. In some embodiments, the present disclosure is directed to a recyclable overcap made from a paper-based material.

As discussed above many paper-based lids do not form a tight seal over the container body when initially applied, and the paper material stretches with every removal and reapplication to the container. The present invention is directed to a paper-based lid defining a circumferential bead circumscribing the base of the lid. The circumferential bead is designed to expand and retract such that the lid may be replaced and removed from a container while maintaining a seal.

BRIEF DESCRIPTIONS OF THE SEVERAL VIEWS OF THE DRAWING(S)

A full and enabling disclosure directed to one of ordinary skill in the art, is set forth in the specification, which makes reference to the appended drawings, in which.

Figure 1B:
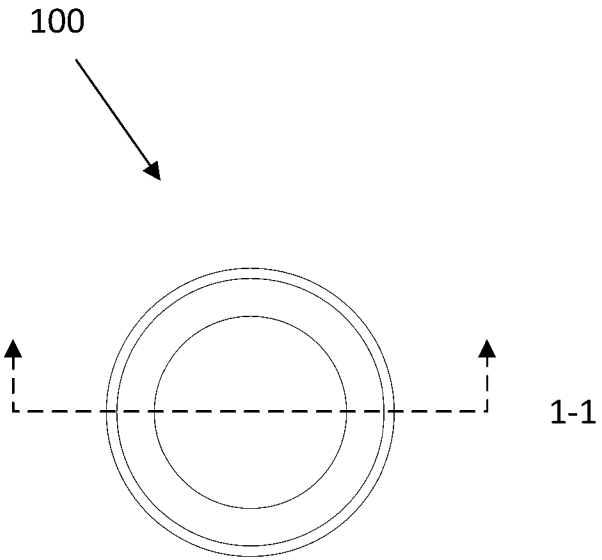
FIG. 1B illustrates a top view of a lid in accordance with some embodiments of the present disclosure.
Figure 1A:
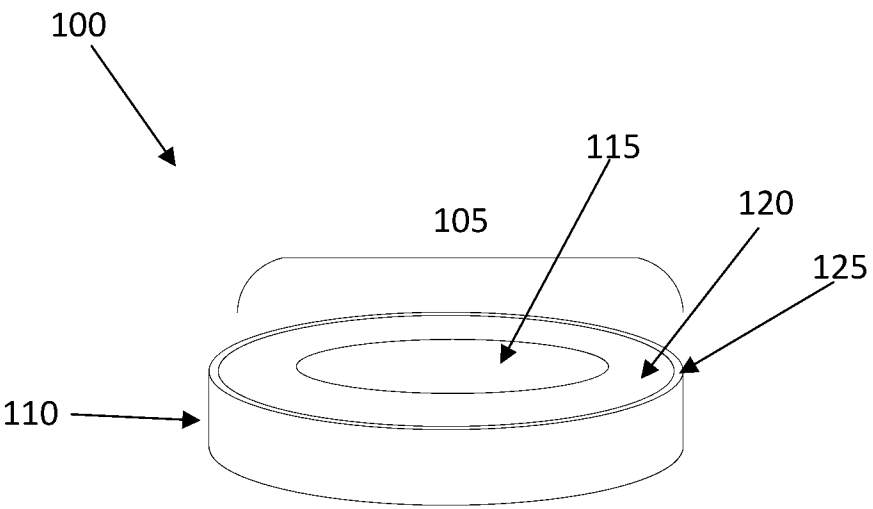
FIG. 1A illustrates a front perspective view of a lid in accordance with some embodiments of the present disclosure.
Figure 1C:
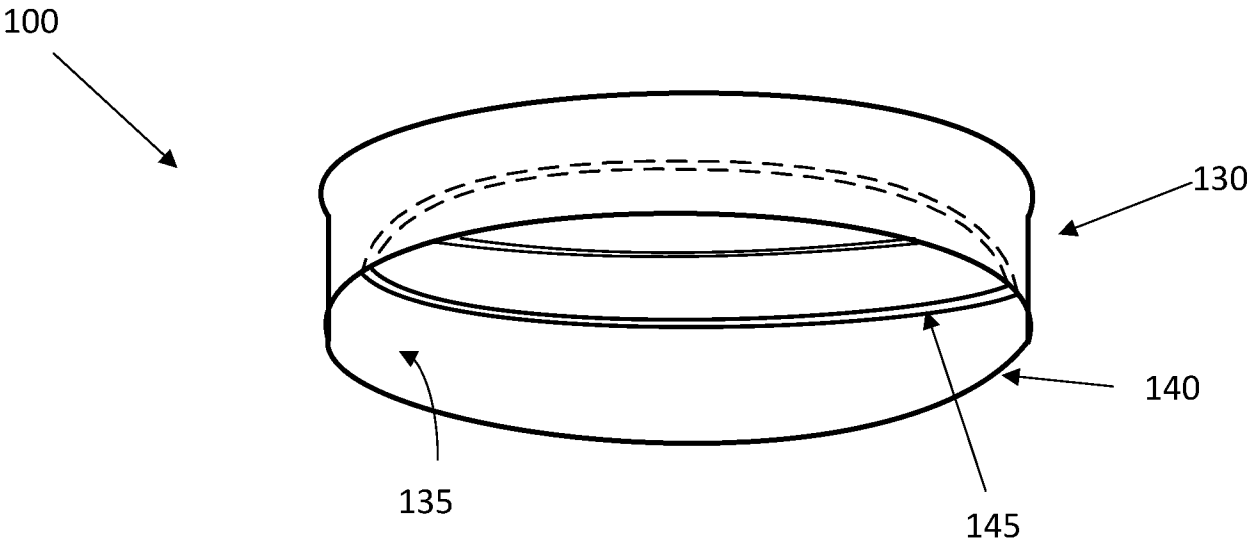
FIG. 1C illustrates a bottom perspective view of a lid in accordance with some embodiments of the present disclosure.

Repeated use of reference characters in the present specification and drawings is intended to represent the same or analogous features or elements of the present disclosure.

DETAILED DISCLOSURE

Reference will now be made in detail to embodiments of the present disclosure, one or more examples of which are illustrated in the accompanying drawings. Each example is provided by way of explanation of the present disclosure, not limitation of the present disclosure. In fact, it will be apparent to those skilled in the art that modifications and variations can be made in the present disclosure without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents.

Overcap

A one-piece paper lid 100 in accordance with a first embodiment of the invention is shown in FIG. 1. The lid 100 may be made from any type of paper known in the art for lidding. The paper may be single ply or multi-ply, may be coated, may include a layer of foil or metallization, and/or may include a barrier layer.

In some embodiments, the lid 100, made from a single piece of paper, comprises a base 105 and a skirt 110. The base 105 may include a central portion 115, and a peripheral portion 120. The peripheral portion 120 may be disposed outwardly of and adjacent to the central portion 115, such that the central portion 115 is surrounded by the peripheral portion 120. In some embodiments, the central portion 115 may be depressed slightly below or raised slightly above the peripheral portion 120, while in other embodiments the central portion 115 may be level with the peripheral portion 120. Such contouring may provide additional strength to the lid and/or may provide useful printing/labeling surfaces for the lidding.

Circumferential Bead

In some embodiments, the skirt 110 may connect to or transition into the peripheral portion 120 of the lid 100 via a circumferential bead 125. The circumferential bead 125 may be disposed radially outward of the peripheral portion 120 of the lid 100 and may be the connection portion between the peripheral portion 120 and the skirt 110. In an embodiment, the circumferential bead 125, in cross-section, may comprise a partial cylinder. For example, the circumferential bead 125 may be half-cylindrical in cross-section. In other embodiments, the cross-sectional shape of the bead 125 may comprise a square, triangle, irregular shape, or any shape known in the art. In an embodiment, the peripheral portion 120 of the lid 100 and the skirt 110 each connect directly to the circumferential bead 125, with no intervening walls disposed therebetween. That is, in this embodiment, there is no upwardly or downwardly disposed transition portion between the peripheral portion 120 of the lid 100 and the circumferential bead 125 or between the skirt 110 and the circumferential bead 125. In an embodiment, the lid 100 is not a drop lid and is not concave.

The circumferential bead 125 may, in an embodiment, be radially extendable to some degree, laterally, away from the peripheral portion 120, as will be explained herein. In some embodiments, the lid 100 has a first inner diameter $D_1$ above the protrusion 145 (see FIG. 2A). In some embodiments, the lid 100 may define a lower diameter $D_L$ below the protrusion 145 (see FIG. 2A).

Figure 2A:
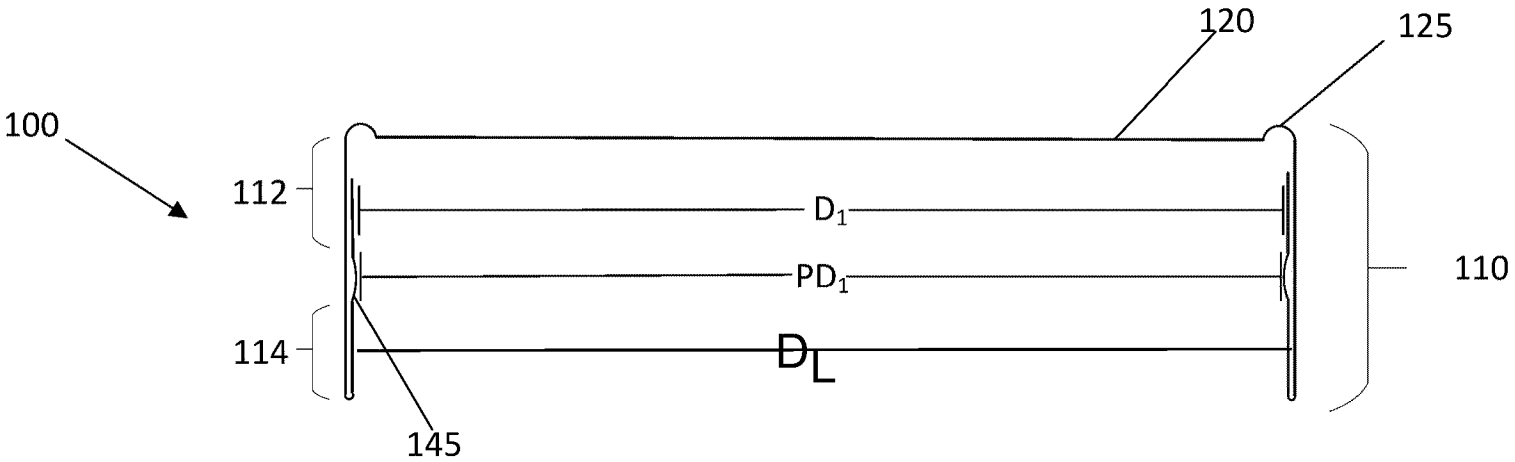
FIG. 2A illustrates a cross sectional view of a lid in accordance with some embodiments of the present disclosure.
Figure 2B:
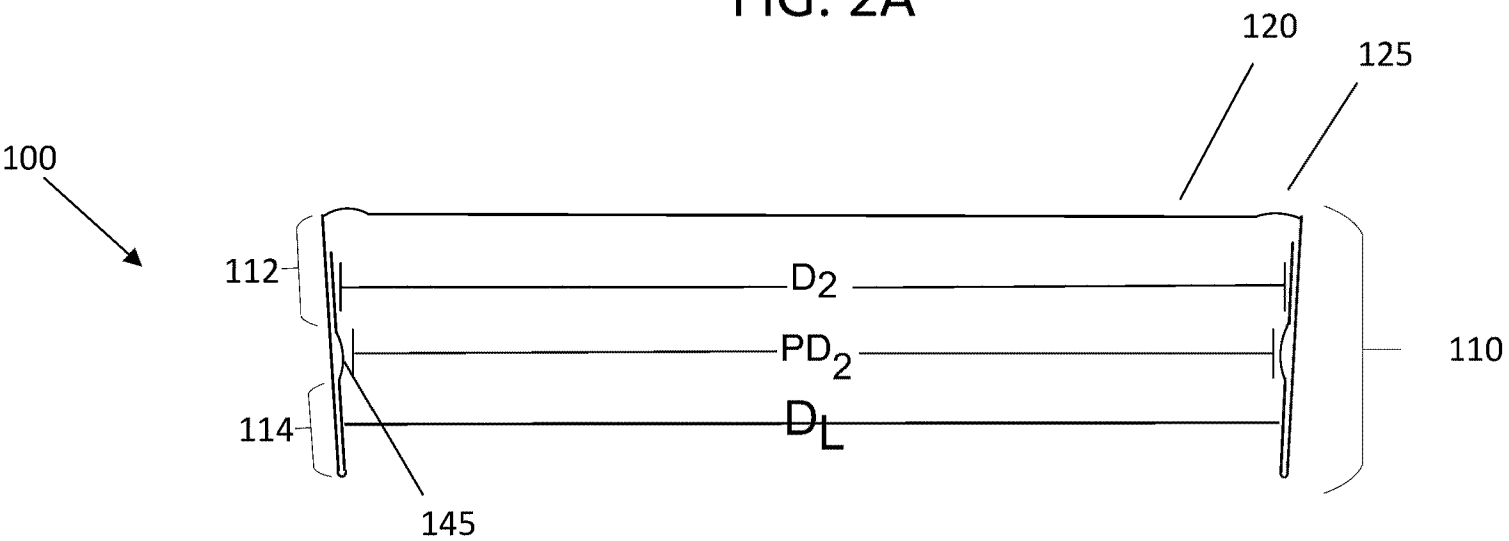
FIG. 2B illustrates a cross sectional view of a lid in accordance with some embodiments of the present disclosure.

In FIG. 2A, the circumferential bead 125 is biased inwardly. In an embodiment, the lid 100 has a second inner diameter $D_2$ (see FIG. 2B) when the circumferential bead 125 is flexed outwardly, such as when the lid 100 is being placed atop a container. The degree of outward flex shown in FIG. 2B may be exaggerated for illustration purposes. Further, the outward flex shown in FIG. 2B is angular, but the flex could also comprise a curved flexion. The second inner diameter $D_2$ may be greater than the first inner diameter $D_1$.

Before the lid 100 is placed over a container opening (FIG. 2A), the skirt 110 may be disposed parallel to the sidewall of the container in an embodiment. Said alternatively, the skirt 110 may be disposed perpendicular to the base 105 of the lid 100. In an embodiment, the first inner diameter $D_1$ of the skirt 110 may be smaller than or equivalent to the outer diameter of the container rim and/or sidewall to which it is designed to be applied. In an embodiment, the skirt 110 scrapes against the rim and/or sidewall of the container as it is applied thereto, while in other embodiments, only the protrusion 145 contacts the container rim and/or container sidewall.

In an embodiment, the circumferential bead 125 is configured to flex, at least partially, radially outward when the lid 100 is placed over a container rim (see FIG. 2B), such that the lid expands from the first diameter $D_1$ to the second diameter $D_2$ to fit over the rim of the container. In an embodiment, this expansion or flexion occurs primarily or only at and/or above the protrusion 145. Said alternatively, the upper portion of the skirt 112 may flex radially outwardly, while the lower portion of the skirt 114 may not flex outwardly. In an embodiment, the upper portion of the skirt 112 may flex radially outwardly to a larger degree than the lower portion of the skirt 114. In an embodiment, minimal or no flexion of the lower portion of the skirt 114 occurs. In an embodiment, the lower portion of the skirt 114 remains stationary or substantially stationary as the lid 100 is placed over a container rim. As shown in FIG. 2B, the flexion appears to be angular or linear, such that the circumferential bead 125 bends, distorts, or deforms to allow the skirt 110 to move angularly outward. However, it is also contemplated that the upper portion of the skirt 112 may bend, curve, or flex outwardly in and of itself, with or without distortion of the circumferential bead 125.

In an embodiment, as the lid 100 is placed over a container rim, the protrusion 145 expands or flexes as the protrusion 145 moves over the rim of the container. In this embodiment, the lower portion of the skirt 114 still remains stationary or substantially stationary. In an embodiment, the container and/or rim of the container are rigid and do not flex inwardly or do not substantially flex inwardly. After the protrusion 145 moves over the rim of the container, in an embodiment, the circumferential bead 125 retracts inwardly to form a tight seat above the rim of the container. In this embodiment, the upper portion of the skirt 112 may flex radially outwardly to accommodate the rim of the container. This flexion may be temporary and may retract after the rim of the container is seated within the lid, or the flexion may be maintained during such time as the lid is seated on the container.

In an embodiment, when the lid 100 is fully seated on the container, the circumferential bead 125 radially retracts towards the biased inward position to form an interference fit between the skirt 110 and/or the protrusion 145 of the lid 100 and the exterior surface and/or rim of the container. In some embodiments, when the lid 100 is removed from a container, the circumferential bead 125 again flexes radially outward to allow the upper portion of the skirt 112 to flex outwardly and the protrusion 145 to move over the rim of the container and then retracts to the biased inward configuration once removed. In some embodiments, the circumferential bead 125 retracts to its biased position completely.

As described, the purpose of the circumferential bead 125 may be to allow the upper portion of the skirt 112 and/or the protrusion 145 to flex outwardly when moving over the rim of a container while allowing the lower portion of the skirt 114 to remain laterally (radially) stationary or substantially laterally (radially) stationary. As shown in FIGS. 2A and 2B, the upper portion of the skirt 112 may allow repetitive lateral movement for multiple lidding and unlidding operations, while the lower portion of the skirt 114 may remain stationary or substantially stationary during lidding and unlidding operations.

Figure 3A:
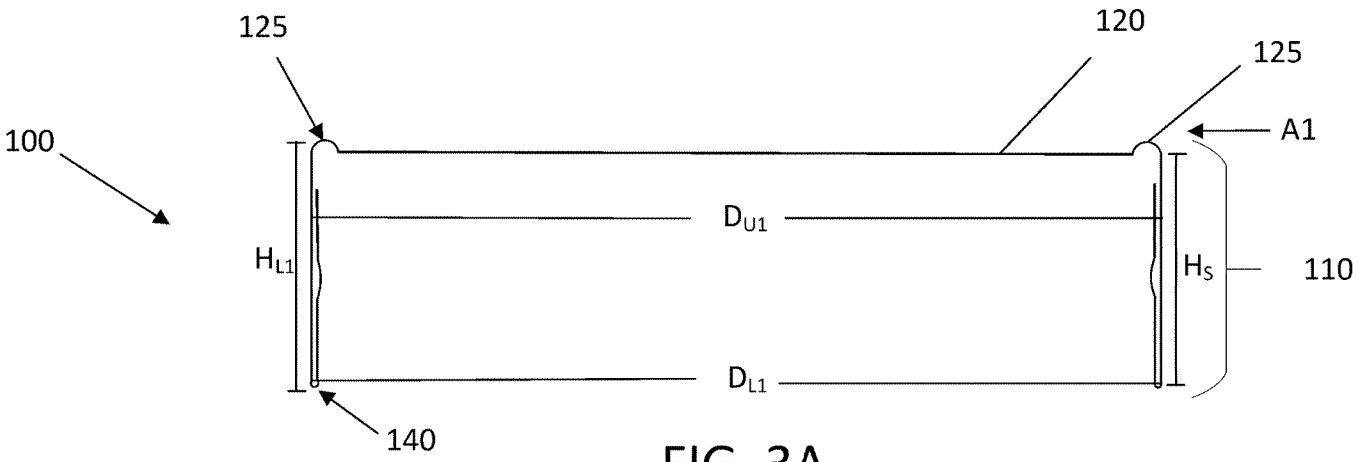
FIG. 3A illustrates a cross sectional view of a lid in accordance with some embodiments of the present disclosure.
Figure 3B:
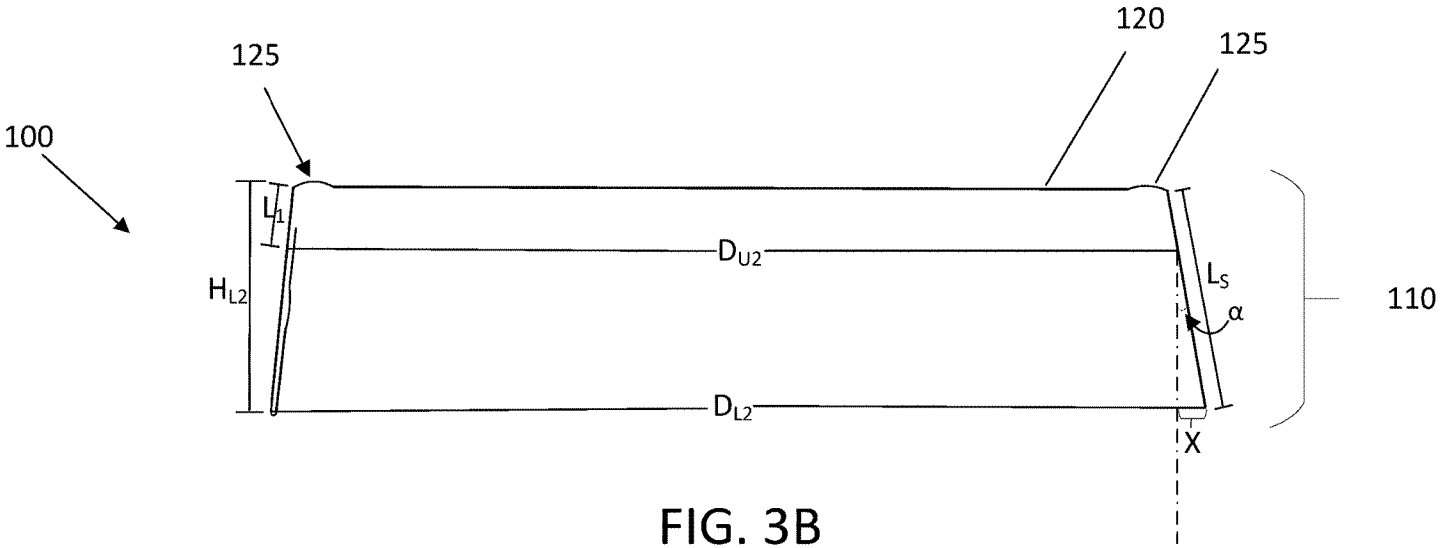
FIG. 3B illustrates a cross sectional view of a lid in accordance with some embodiments of the present disclosure.
Figure 3C:
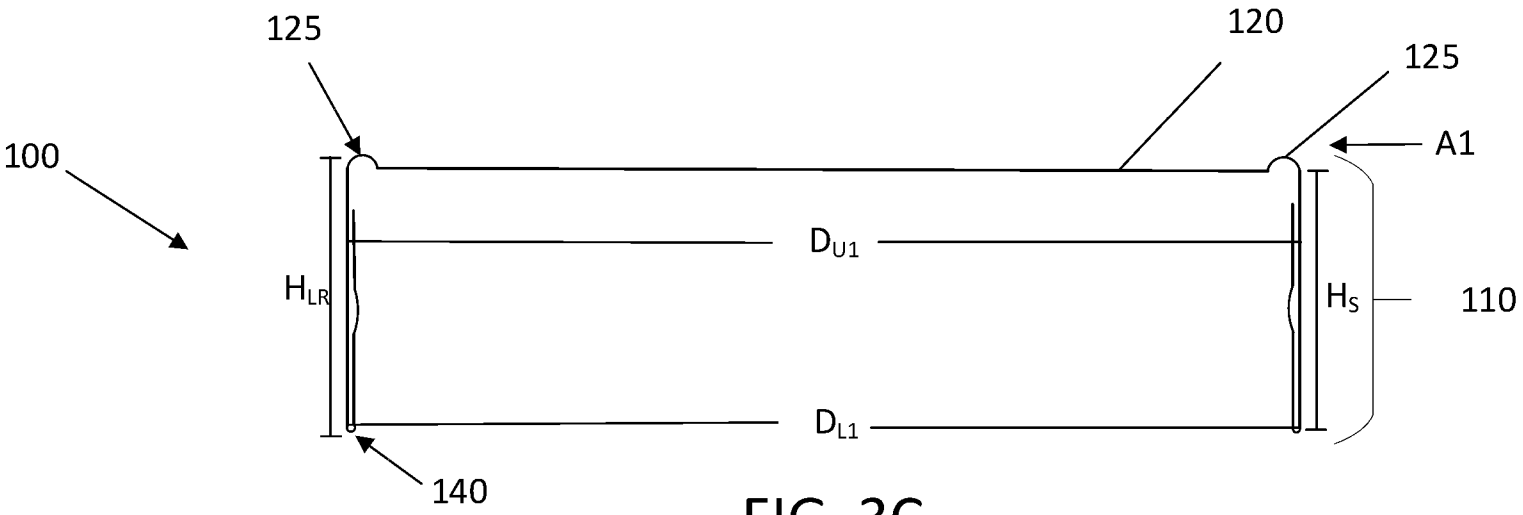
FIG. 3C illustrates a cross sectional view of a lid in accordance with some embodiments of the present disclosure.

In some embodiments, as illustrated in FIGS. 3A-C the circumferential bead 125 radially extends when the lid is place upon a container, and the extension causes the circumferential bead 125 to radially stretch and, in some embodiments, the curvature of the circumferential bead 125 may flatten. In some embodiments, as illustrated in FIG. 3A, the lid 100 defines a first lid height $H_{L1}$ extending from the curl 140 to the top of the circumferential bead 125. The first lid height $H_{L1}$ may be the height of the lid 100 after manufacture but before application onto a container. The lid 100 may also define a skirt height $H_S$. The skirt height $H_S$ may extend between the curl 140 and the base 120 of the lid 120. The skirt height $H_S$ may be constant after manufacture and after application onto a container. In some embodiments, the difference between the first lid height $H_{L1}$ and the skirt height $H_S$ may be the height of the circumferential bead 125. In some embodiments, the difference between the first lid height $H_{L1}$ and the skirt height $H_S$ may be between 0.5-5 mm, between 0.6-3 mm, or even between 0.75-2 mm.

In some embodiments, the first lid height $H_{L1}$ may decrease to a second lid height $H_{L2}$ when the circumferential bead 125 is extended to the outward position. As the position of the base 120 remains constant, the skirt height $H_S$ also remains constant. Thus, the difference in the second lid height $H_{L2}$ and the skirt height $H_S$ defines the height of the circumferential bead in the outward position. In some embodiments, the height of the circumferential bead in the outward position may be between 0.25-2 mm, between 0.35-1.5 mm or even 0.45-1 mm. In some embodiments, the height of the circumferential bead 125 may decrease between 20-60%, between 30-50% or between 35-45% when extended from the inward position to the outward position. In some embodiments, the height of the circumferential bead 125 decreases by 40% when extended to the outward position.

In some embodiments, as illustrated in FIG. 3C, the circumferential bead 125 may return to the inward position and the lid may return to the first lid height $H_{L1}$, while in other embodiments, when returned to the inward position, the circumferential bead 125 may retain a slight extension, and the lid may define a return lid height $H_{LR}$ wherein the return lid height $H_{LR}$ is slightly smaller than the first lid height $H_{L1}$, and larger than the second lid height $H_{L2}$.

In some embodiments, the circumferential bead 125 may have a lifetime number of cycles. In some embodiments, a cycle is a radial extension of the circumferential bead 125 from the first lid height $H_{L1}$ to the second lid height $H_{L2}$ and radial retraction from the second lid height $H_{L2}$ to the first lid height $H_{L1}$. A first cycle may be putting the lid 100 onto a container, and a second cycle may be removing the lid 100 from the container. In some embodiments, the circumferential bead 125 may be configured to maintain a seal between the protrusion 145 and the container for up to 100 cycles, up to 200 cycles, or even up to 500 cycles. In some embodiments, the circumferential bead 125 may be configured to retain the seal for at least 50 cycles, at least 100 cycles or even at least 150 cycles.

In some embodiments, the lid 100 may be formed from a paper material which has elastic properties. In an embodiment, the paper material may stretch up to 20% (e.g., FibreForm®, commercially available from BillerudKorsnäs). In some embodiments, the lid may be formed from a paper material made from post-industrial or post-consumer recycled materials. In some embodiments, the lid 100 may be made from cupstock.

In some embodiments, the lid 100 may include up to or at least 95% paper. In other embodiments, the lid may comprise 100% paper. The lid 100 may be printed, coated (interior or exterior), and/or may include additives. The lid 100 may comprise a multi-layer structure wherein at least one of the layers comprises a barrier layer. In some embodiments, the paper may have a high tensile strength and a high stretchability, while in other embodiments the paper may have either a high tensile strength or a high stretchability.

Skirt Features

Figure 1D:
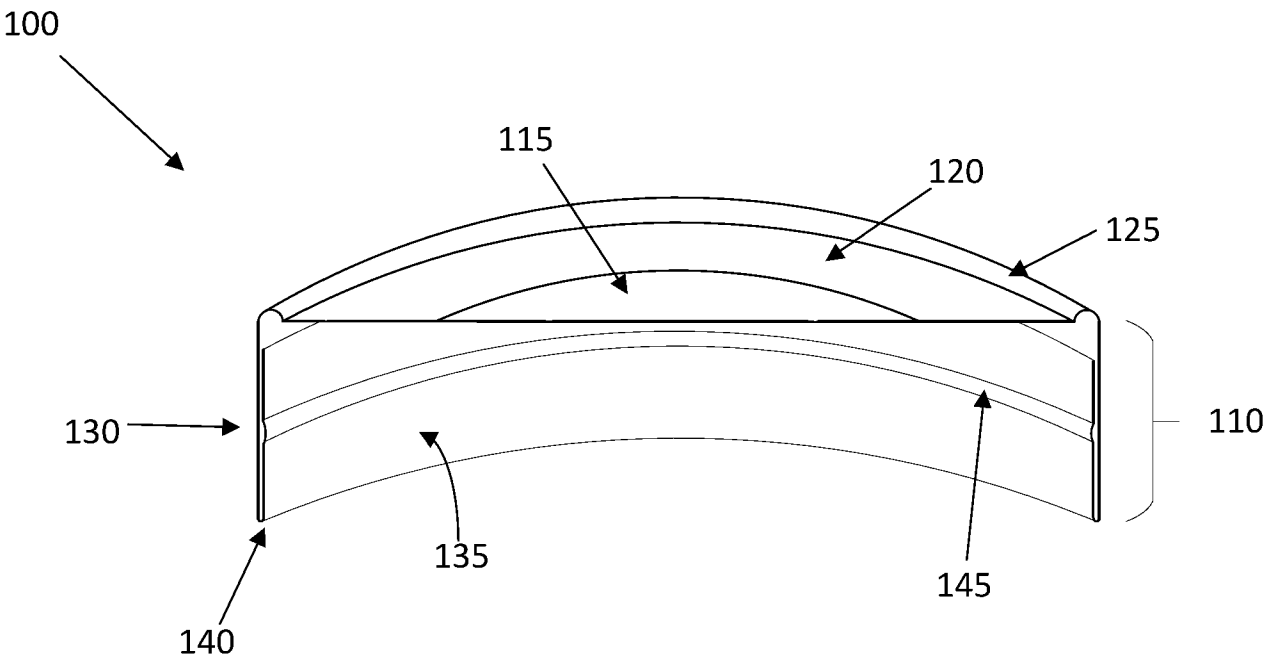
FIG. 1D illustrates a perspective cross-sectional view of a lid taken along line 1-1 in accordance with some embodiments of the present disclosure.

Illustrated in FIG. 1D, in some embodiments, the skirt 110 of the lid 100 comprises two or more layers of the same blank curled, rolled, or folded against one another (also referred to as sidewalls), an inner layer and an outer layer. In some embodiments, the skirt 110 comprises an outer sidewall 130 (facing outwardly from the central axis of the lid) and an inner sidewall 135 (facing inwardly toward the central axis of the lid 100). The outer sidewall 130 may extend downward from the circumferential bead 125 and the inner sidewall 135 may extend upward from the fold or curl 140, towards the circumferential bead 125. As noted, in some embodiments, the outer sidewall 130 may include an inwardly and upwardly extending curl or fold 140 extending between and connecting the outer sidewall 130 and the inner sidewall 135 opposite the circumferential bead 125. In some embodiments, the inner sidewall 135 may extend the entire length of the outer side wall 135. In other embodiments, the inner sidewall 135 may only extend upwardly a portion of the outer sidewall 130. In other terms, in some embodiments, the inner sidewall 135 may extend to abut or be adjacent the peripheral portion 120 of the base 105, while in other embodiments, the inner sidewall may extend to a position halfway, two thirds of the way, or three quarters of the way between the fold 140 and the peripheral portion 120 of the base 105.

In some embodiments, the curl or fold 140 may be compressed such that there is no space between the inner sidewall 135 and the outer sidewall 130. In other embodiments, the curl may provide a gap between the inner sidewall 135 and the outer sidewall 130. Likewise, in some embodiments, the inner sidewall 135 and the outer sidewall 130 may be compressed against one another such that there is no gap therebetween.

In some embodiments, the skirt 110 may further comprise at least one inner protrusion 145. In some embodiments, inner protrusion 145 may be disposed circumferentially about the inner sidewall 135 of the skirt 110. In some embodiments, the inner protrusion 145 may be formed in the vertical center of the skirt 110, while in other embodiments, the inner protrusion 145 may be closer to the base 105, or the curl 140. In some embodiments, the specific vertical location of the inner protrusion 145 on the skirt 110 may aid in providing a tighter fit of the lid on the container rim.

In some embodiments, the inner protrusion 145 is continuous about the circumference of the inner sidewall 135 of the skirt 110, while in other embodiments, there may be a plurality of inner protrusions 145 spaced about the circumference of the inner sidewall 135. In embodiments having multiple inner protrusions 145 the protrusions may be evenly spaced about the circumference.

The inner protrusion 145 may be configured to have a smaller inner diameter $PD_1$ than the inner diameter $D_1$ of the inner sidewall 135 of the lid 100 (see FIG. 2A). The inner diameter of the inner protrusion 145 may be greater than the outer diameter of the container sidewall in an embodiment, such that the protrusion never contacts the sidewall of the container. In this embodiment, once the lid 100 is placed over the rim of a container (the rim having a greater outer diameter than the sidewall of the container), the inner protrusion 145 forms an interference fit against the rim of the container and prevents the lid from uncoupling with the container over the rim without application of force.

Alternatively, the inner protrusion 145 may be configured to interact with a sidewall of a container in an embodiment, such that the inner diameter $PD_1$ is approximately equivalent to the outer diameter of the sidewall. In this embodiment, once the lid 100 is placed over the rim of a container (the rim having a greater outer diameter than the sidewall of the container), the inner protrusion 145 forms an interference fit with the container sidewall and prevents the lid from uncoupling with the container over the rim without application of force, such that the lid 105 may not easily slide off the container sidewall.

In an embodiment, the rim and the protrusion 145 resist movement beyond each other when the lid 100 is positioned fully on a container. The inner protrusion 145 may be configured to have a first diameter $PD_1$ (in the biased position) which is less than the outer diameter of the container rim. The inner protrusion 145 may be configured to have a second diameter $PD_2$ when the lid 100 is in an expanded position (see FIG. 2B). The second protrusion diameter $PD_2$ may be greater than the first protrusion diameter $PD_2$. The expansion of the lid 100 may be sufficient such that the second protrusion diameter $PD_2$ is equivalent to or substantially equivalent to the outer diameter of the container rim when the lid 100 is in the expanded position. In this embodiment, the inner protrusion 145 may move over the rim of the container via application of human force and when the lid 100 retracts to its inwardly biased position, the inner protrusion may again have a diameter which is less than the outer diameter of the container rim, thereby retaining the lid 100 on the container.

In an embodiment, the protrusion 145 may comprise any shape known in the art. In an embodiment, (see FIG. 2A), a cross-sectional view of the protrusion 145 comprises a partial cylindrical shape, such as a half-cylinder. In other embodiments, the cross-sectional view of the protrusion 145 may comprise a square, rectangle, triangle or irregular shape. Any shape known in the art to retain the lid 100 on a container rim is encompassed herein.

In some embodiments, the skirt 110 may flex in an outward direction, such that the skirt exhibits a degree of flex $\alpha$. Returning to FIGS. 3A-C the lid 100 may define an upper outer diameter $D_{U1}$ and a lower outer diameter $D_{L1}$. Each of the upper outer diameter and the lower outer diameter may be the diameter of the lid 100 extending between the outer surface of the skirt 110. In some embodiments, in the inward position the upper outer diameter $D_{U1}$ and the lower outer diameter $D_{L1}$ may be equivalent. In some embodiments, illustrated in FIG. 3B in the extended state the circumferential bead 125 is extended, and the skirt 110 may be flexed outward, such that a second upper outer diameter $D_{U2}$ is less than a second lower outer diameter $D_{L2}$. The degree of flex $\alpha$ may be determined based on the difference X in the upper outer diameter $D_{U2}$ and the lower outer diameter $D_{L2}$, in addition to a length of the skirt $L_S$. In some embodiments, a small degree of flex $\alpha$ is desired. In some embodiments, the degree of flex $\alpha$ may be less than 5%, less than 3% or even less than 1%.

In some embodiments, the upper outer diameter $D_{U2}$ is measured at a point below the base 120 or the circumferential bead 125. Thus, to accurately determine the degree of flex $\alpha$ a length of measure $L_1$ must be subtracted from the skirt length $L_S$.

In some embodiments, the paper to make lid 100 may be preprinted with a design, pattern, logo, color, or other source identifying marks, while in other embodiments, the color, design, pattern, logo, or source identifiers may be printed or added to the lid 100 after manufacture. In some embodiments, a lacquer may be applied to the exterior and/or interior of the lid 100.

In some embodiments, the bottom closure may be recessed into the bottom end of the container and may form a seal with an interior surface of a cylindrical container body. The container body and bottom closure may comprise a plurality of layers, including one or more paper-based layers. The one or more paper-based layers of the cylindrical container body and bottom closure may comprise at least about 95% by mass of the container assembly. This percentage of paper content may advantageously qualify the container assemblies as mono material, allowing them to be accepted in the recycling streams of most countries globally.

Figure 4:
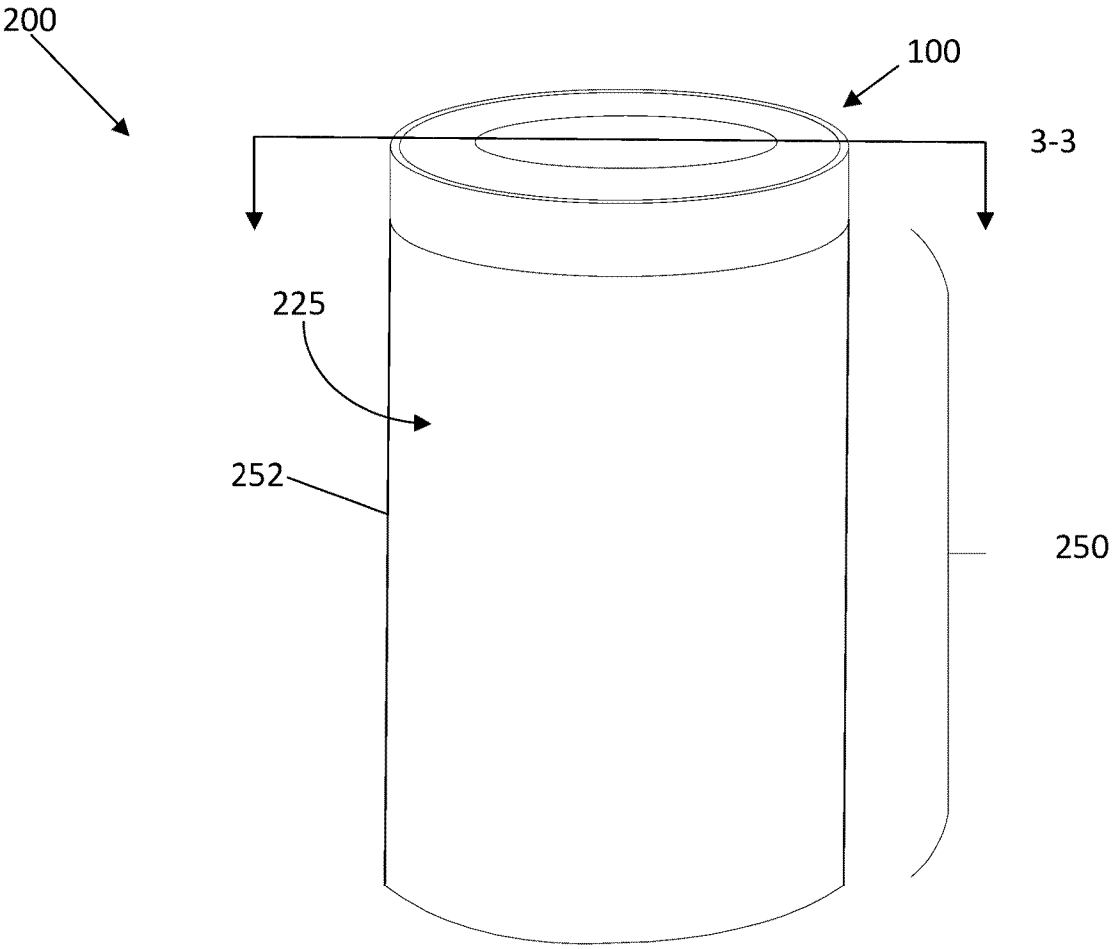
FIG. 4 illustrates a container system in accordance with some embodiments of the present disclosure.
Figure 5:
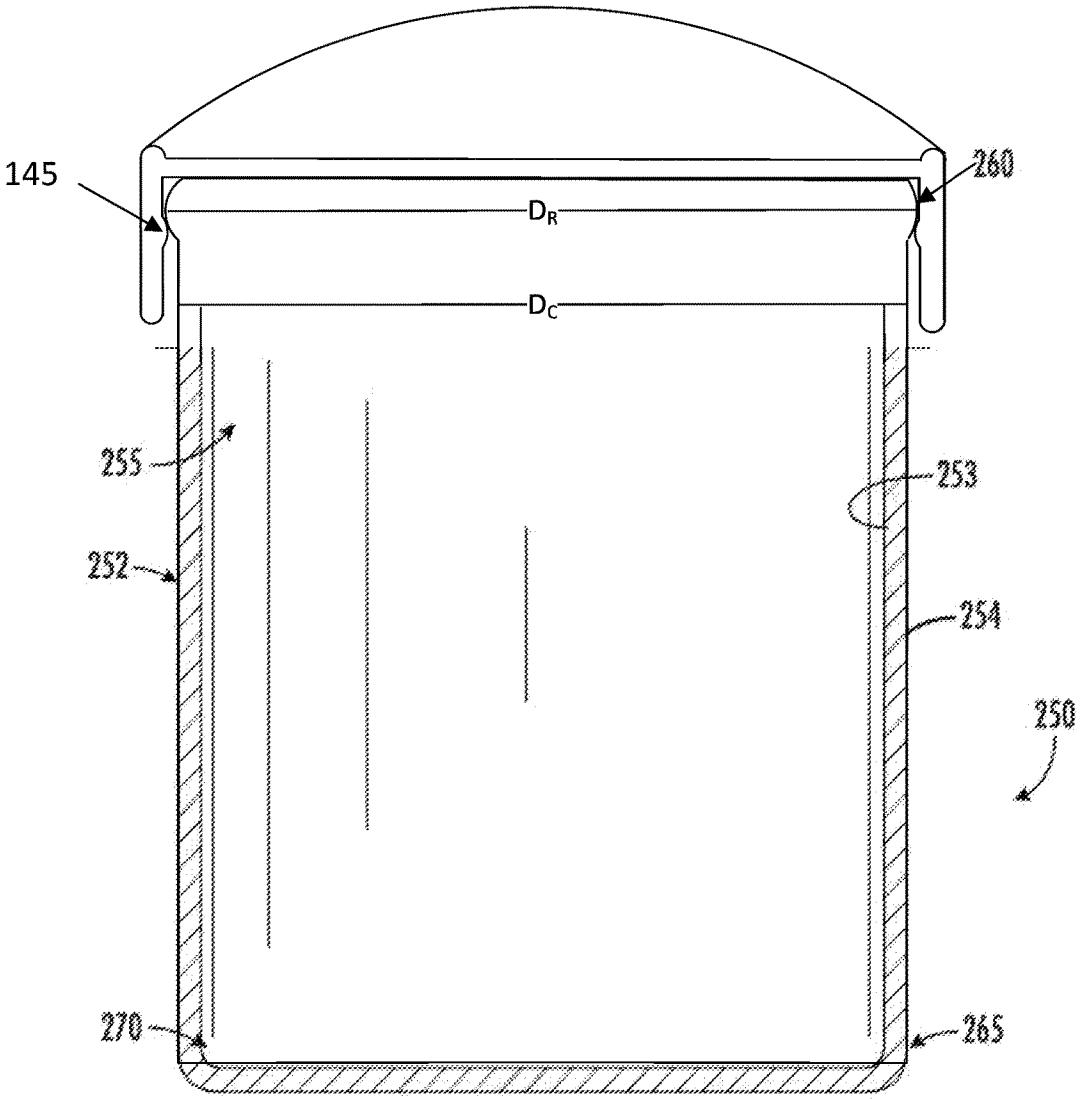
FIG. 5 illustrates a cross-sectional view of a container system taken along line 3-3 in accordance with some embodiment of the present disclosure.

A container assembly 200 is shown in FIGS. 4-5. The container system 200 may include a lid 100 and a container 250. The container 250 may have a sidewall 252 defining an upper end 255, wherein the upper end includes a top rim 260 circumscribing a top end of the sidewall 252, and a bottom peripheral edge 265 circumscribing a bottom end of the sidewall 252. The bottom end may comprise a bottom closure 270, optionally recessed into the container body 250. The top rim 260 may be a rolled rim and may have an outer diameter $D_R$ that is larger than the outer diameter $D_C$ of the container sidewall 252. Alternatively, the top rim 260 may comprise a metal (or other material) end having bead, wherein the end is seamed onto the container. For example, the metal end may have a peelable aluminum membrane, easy-open ("EZO") function, or ring-pull, and the bead may also have an outer diameter that is larger than the outer diameter of the container sidewall 252.

In some embodiments, the container body 250 may comprise a rigid cylinder. In such cylindrical embodiments, the container body 250 may have an inner diameter of about 3-16 cm (about 1-8 in.). For example, the container body 250 may have an inner diameter of about 7.315 cm (about 2.880 in.). In some cylindrical embodiments, the container body 250 may have an outer diameter $D_C$ within a range of about 3-20 cm (about 1-8 in.). For example, the container body 250 may have an inner diameter of about 7.630 cm (about 3.004 in.). The bottom closure 270 of the container 250 may be circumscribed by a bottom peripheral edge 265 formed by the terminating edge of the sidewall 252 that forms the body of the container body 250. The sidewall 252 may include an interior surface 253 facing the container interior and an exterior surface 254 facing the outside of the container body 250. The interior surface 253 may be the product-facing side of the sidewall 252 of the container body 250. In some embodiments, the product(s) may be food products, and the interior surface 253 may include a food safe layer, lacquer, film, liner, and/or coating to help protect the integrity of the food product(s) to be contained within the container body 250. The exterior surface 254 may include printing or other applied graphics for labeling and/or advertising the product(s) to be contained within the container body 250. In an embodiment, the outer surface of the lid 100 may be coated with polyethylene or any lacquer known in the art.

In some embodiments, the sidewall 252 of the container body 250 may have a thickness (e.g., as measured from the interior surface 253 to the exterior surface 254 of the container sidewall 252) of about 0.05-0.2 cm (about 0.02-0.787 in.). For example, the sidewall 252 of the container body 250 may have a thickness of about 0.157 cm (0.062 in.).

As discussed with reference the lid 100, the first inner diameter $D_1$ is smaller than the outer diameter of the rim, also referred to as the rim diameter $D_R$ of the container 200. Thus, before application of the lid 100 onto the container 200 the skirt 125 may rest on the rim of the container 200. In some embodiments, to overcome the difference in diameters the lid 100 may be applied onto the container 200 using an application of force. A minimal force allows the upper portion of the skirt to flex, via the circumferential bead 125. The flex within the circumferential bead 125 allows the first inner diameter $D_1$ and the first protrusion diameter $PD_1$ to expand to the second inner diameter $D_2$ and the second protrusion diameter $PD_2$. The second protrusion diameter $PD_2$ is slightly larger than the rim diameter $D_R$, thus allowing the protrusion to shift about the rim an create a seal about the container 200.

In some embodiments, the upper portion 112 of the skirt is about the height of the rim, such that the protrusion 120 rests slightly under the widest part of the rim of the container 200, thus protrusion 120 creates a seal with a portion of the rim.

In other embodiments, the first inner diameter $D_1$ of the lid 100, is approximately equivalent to the rim diameter $D_R$, thus in the inward state, (e.g., after the protrusion 120 is over the rim) the inner portion of the skirt may be in contact with the rim, thereby forming an interference fit.

While the container may be cylindrical, is should not be so limited. In some embodiments, the container may have a square, hexagonal, pentagonal, rectangular, triangular, or irregular cross-section. The lid 100 may have a shape and configuration which correlates to the cross-section of the container 250. Thus, for a cylindrical container, the lid 100 may be disc shaped. However, a container with a square cross section may be fitted with a square lid, for example.

In some embodiments, the rigid sidewall 252 of the container body 250 may include multiple layers, such as a paper-based layer, a barrier layer, an ionomer layer, and/or a tie layer, for example. Each component layer (paper-based layer, a barrier layer, ionomer layer) may comprise a single layer or may comprise a plurality of layers.

In an embodiment, the lid 100 is strong enough to withstand transportation of the container on its lid 100, from the production line to the customer. Likewise, the lid 100 is strong enough to withstand the filling and finishing of the container by the customer, transportation to retail stores, and ultimately transportation to the home of the consumer and use/reuse by the consumer. In an embodiment, the lid 100 is able to withstand temperature and humidity changes that may occur during transportation. In an embodiment, the lid 100 protects the goods contained within the container, is optically/aesthetically acceptable, is recyclable (preferably in the same stream as the container body), and meets other customer requirements.

In some embodiments, the paper lid 100 may be used in connection with a membrane seal. In this embodiment, the membrane seal may be sealed onto the container rim prior to application of the paper lid 100 thereto. In other embodiments, the paper lid 100 itself may be sealed onto a container rim and may, therefore, avoid the need for a membrane seal. That is, the lid 100 may form a hermetic seal with the rim of the container in an embodiment.

EXAMPLES

To illustrate the change of the circumferential bead height and the skirt height throughout the use of the lid, measurements of the lid were taken during each phase with a measuring clock. The measuring clock uses relative measurements for both the lid height $H_{L1}$ and the skirt height $H_S$, however the circumferential bead height $\Delta$ is an absolute measurement as the difference between the lid height $H_L$ and the skirt height $H_S$. The measurements were taken at three points about the lid, each spaced about 120 degrees apart. Table 1 illustrates measurements for a lid before application, during application, and after removal from a container.

TABLE 1

| | Before container application | | | On container | | | Removed from container | | | Δ before and after | Δ before application and after |
|---|---|---|---|---|---|---|---|---|---|---|---|
| Point | $H_{L1}$ (mm) | $H_S$ (mm) | Δ | $H_{L2}$ (mm) | Low (mm) | Δ | High (mm) | $H_S$ (mm) | Δ | application | removal |
| 1.1 | 5.00 | 4.10 | 0.90 | 2.60 | 2.10 | 0.50 | 4.85 | 4.10 | 0.75 | 0.40 | 0.15 |
| 1.2 | 5.35 | 4.05 | 1.30 | 2.68 | 2.10 | 0.58 | 5.25 | 4.05 | 1.20 | 0.72 | 0.10 |
| 1.3 | 5.10 | 4.20 | 0.90 | 2.80 | 2.10 | 0.70 | 4.95 | 4.20 | 0.75 | 0.20 | 0.15 |
| Mean | 5.15 | 4.12 | 1.03 | 2.69 | 2.10 | 0.59 | 5.02 | 4.12 | 0.90 | 0.44 | 0.13 |

Each point along the circumference was assigned a point number to be measured for each stage in the trial, and an average measurement was calculated for the lid. As indicated by the change before the application and after removal, it is seen the circumferential bead flattens out (e.g., outward state) when applied to a container, and returns to an arched shaped (e.g., inward state) when removed from the container. As discussed above the lid may be applied and removed at least 20, at least 35 or even at least 50 times before the circumferential bead remains in the extended state.

Table 2 displays the mean data for ten different lids, and the overall mean of the change in the circumferential bead height between forming, application to a container and removal from the container.

TABLE 2

| | Before container application | | | On container | | | Removed from container | | | Δ before | Δ before application |
|---|---|---|---|---|---|---|---|---|---|---|---|
| Lid | $H_{L1}$ (mm) | $H_S$ (mm) | Δ | $H_{L2}$ (mm) | Low (mm) | Δ | High (mm) | $H_S$ (mm) | Δ | and after application | and after removal |
| 1 | 5.15 | 4.12 | 1.03 | 2.69 | 2.10 | 0.59 | 5.02 | 4.12 | 0.90 | 0.44 | 0.13 |
| 2 | 5.27 | 4.25 | 1.02 | 4.13 | 3.53 | 0.61 | 5.17 | 4.25 | 0.92 | 0.41 | 0.10 |
| 3 | 5.33 | 4.37 | 0.96 | 4.07 | 3.31 | 0.76 | 5.17 | 4.37 | 0.80 | 0.20 | 0.16 |
| 4 | 5.10 | 4.17 | 0.93 | 3.78 | 3.25 | 0.53 | 4.98 | 4.17 | 0.82 | 0.40 | 0.12 |
| 5 | 5.10 | 4.09 | 1.01 | 3.80 | 3.29 | 0.51 | 4.96 | 4.09 | 0.87 | 0.50 | 0.14 |
| 6 | 5.26 | 4.19 | 1.07 | 4.13 | 3.41 | 0.73 | 5.09 | 4.19 | 0.90 | 0.34 | 0.17 |
| 7 | 5.17 | 4.29 | 0.88 | 3.90 | 3.45 | 0.45 | 5.04 | 4.29 | 0.75 | 0.43 | 0.13 |
| 8 | 5.07 | 4.28 | 0.78 | 3.88 | 3.43 | 0.45 | 4.94 | 4.28 | 0.65 | 0.33 | 0.13 |
| 9 | 5.23 | 4.22 | 1.02 | 3.99 | 3.42 | 0.57 | 5.03 | 4.22 | 0.82 | 0.44 | 0.20 |
| 10 | 5.18 | 4.35 | 0.83 | 4.05 | 3.42 | 0.63 | 5.02 | 4.35 | 0.67 | 0.20 | 0.16 |
| Overall | 5.19 | | 0.95 | | | 0.58 | 5.042 | | 0.81 | 0.37 | 0.14 |

As indicated by Table 2, the height of the circumferential bead decreases between 30-50% between the inward state (e.g., before container application) and the extended state (e.g., on container). Thus, rather than relying only on the degree of flex α in the skirt, to retain the lid on the container, the lid also uses the circumferential bead to retain the seal between the protrusion and the rim of the container.

As further indicated by Table 2 the height of the circumferential bead decreases by about 2.5% after application and removal from a container. Thus, the bead retains its shape and is able create a desired seal about the container even after the multiple applications.

To further illustrate the improvements the circumferential bead exhibits the present lid 100 was compared with a lid existing in the prior art. Although both lids flex, the circumferential bead of the present invention radially extends, allowing the skirt to maintain a more vertical orientation, and thus, retains a better seal, and may be less likely to be accidently removed. Table 3 displays the starting characteristics of each of the lids.

TABLE 3

| Lid | Prior Art | Invention |
|---|---|---|
| Skirt height | 8.5 mm | 10 mm |
| Inside diameter reciving bell | 79.7 | 80.1 |
| Material thickness toolset design | 1.8 | 2.16 |
| Material thickness used | 1.6 | 1.8 |
| Theoretical inside diameter material | 77.9 | 77.94 |
| Theoretical inside diamter used | 78.1 | 78.3 |
| Can diameter | 78.6473 | 78.6473 |

In this experiment, the inventors compared the degree of flex for each of the lid when positioned on a container. Although the lids define different dimensions, the degree of flex can be compared across lids of varied dimensions, as it looks at the angle of the skirt.

After application to the container, the upper outer diameter (see e.g., $D_{U2}$ of FIG. 3B) and the lower outer diameter (see e.g., $D_{L1}$ of FIG. 3B) of each lid were measured. The difference in the diameters creates an angle between the skirt and vertical. The degree of flex may indicate how easily the lid is removed and may affect the tightness of the seal. Table 4 illustrates the measurements of the prior art lid and table 5 illustrates the measurements of the lid of the present invention.

TABLE 4

| Lid Number | Upper Diameter (mm) | Lower Diameter (mm) | Δ (mm) | Angle (°) |
|---|---|---|---|---|
| 1 | 80.2629 | 81.7534 | 1.4905 | 5.345210087 |
| 2 | 80.3373 | 81.6939 | 1.3566 | 4.863805404 |
| 3 | 80.3688 | 81.6192 | 1.2504 | 4.482235573 |
| 4 | 80.3511 | 82.2504 | 1.8993 | 6.817442479 |
| 5 | 80.1432 | 82.3085 | 2.1653 | 7.777774901 |
| 6 | 80.2662 | 82.5615 | 2.2953 | 8.247894252 |
| 7 | 80.2675 | 82.2764 | 2.0089 | 7.212879642 |
| 8 | 80.3441 | 82.2157 | 1.8716 | 6.717553171 |
| 9 | 80.3297 | 81.8301 | 1.5004 | 5.380817724 |
| 10 | 80.3503 | 81.9452 | 1.5949 | 5.720815737 |
| Mean | 80.30211 | 82.04543 | 1.74332 | 6.256642897 |

TABLE 5

| Lid Number | Upper Diameter (mm) | Lower Diameter (mm) | Δ (mm) | Angle (°) |
|---|---|---|---|---|
| 1 | 80.7917 | 81.0898 | 0.2981 | 0.898977509 |
| 2 | 80.6571 | 80.9225 | 0.2654 | 0.800357601 |
| 3 | 80.6483 | 80.8067 | 0.1584 | 0.4776714 |
| 4 | 80.7804 | 81.0958 | 0.3154 | 0.951153627 |
| 5 | 80.6371 | 81.0136 | 0.3765 | 1.135435421 |
| 6 | 80.6071 | 80.7906 | 0.1835 | 0.55336521 |
| 7 | 80.8307 | 80.9297 | 0.099 | 0.298542518 |
| 8 | 80.7364 | 80.7952 | 0.0588 | 0.177315643 |
| 9 | 80.9383 | 81.1739 | 0.2356 | 0.710485874 |
| 10 | 80.6535 | 80.8597 | 0.2062 | 0.621822193 |
| Mean | 80.72806 | 80.94775 | 0.21969 | 0.6625127 |

As illustrated, the skirts of the prior art lid display a larger degree of flex, as the prior art lid does not include a circumferential bead which is radially extendable. As such, the skirt is required to flex to engage with the rim of the container.

In contrast, the circumferential bead (e.g., 125) of the invention radially extends, thereby allowing the skirt to maintain a more vertical orientation and thus retaining a seal between the lid and the container. In addition to providing a tighter seal between the lid and the container, the lid defining a more vertical skirt when positioned on the container exhibits many benefits. For example, the skirt orientation may prevent chiming between the lids on containers, and thus, may prevent unusable product. Each container system (e.g., container and lid) may take up less space. The tighter configuration also helps to prevent objects from getting under the lid and causing the lid to be removed from the container.

Systems and Methods

In some embodiments, systems, tooling, and methods are provided for manufacturing a lid 100 using a deep draw process. Generally speaking, a deep draw device can be any device or mechanism that draws a blank radially into a forming die by the mechanical action of a punch. A deep draw device provides a shape transformation and in some cases the depth of the drawn lid exceeds its diameter. The peripheral region of the blank experiences a radial drawing stress and a tangential compressive stress. These compressive stresses (hoop stresses) result in wrinkles about the skirt of the drawn lid. Wrinkles can be reduced by using a blank holder (sometimes called a blank holder), the function of which is to facilitate controlled material flow into the die radius.

In an embodiment, the method for making the lids 100 may comprise a variety of steps (See FIG. 5). Some steps may be omitted in some embodiments and other steps may be added in some embodiments. One of ordinary skill in the art will understand such modifications. At a first station 310, the paper may be provided as a roll or reel which may be suspended at a first end of the lid formation assembly process 300. The width of the paper roll may be slightly larger than the width of the discs that will be cut therefrom to form lids. In an optional embodiment, at a second station 325 the paper roll is fed through a moisturizing station wherein the paper is appropriately moisturized to ensure consistent manufacture of the lidding.

Figure 6:
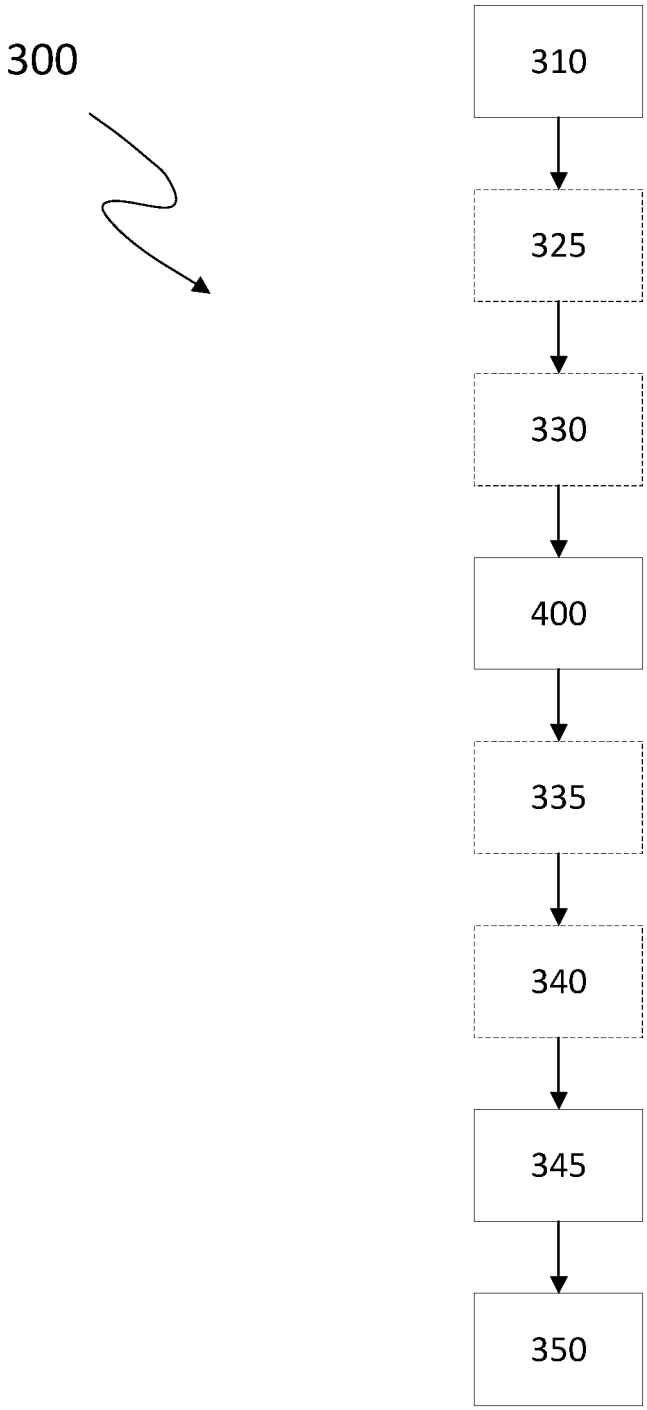
FIG. 6 illustrates a block diagram of an example assembly module, for manufacturing lids in accordance with some embodiments of the present disclosure.
Figure 7:
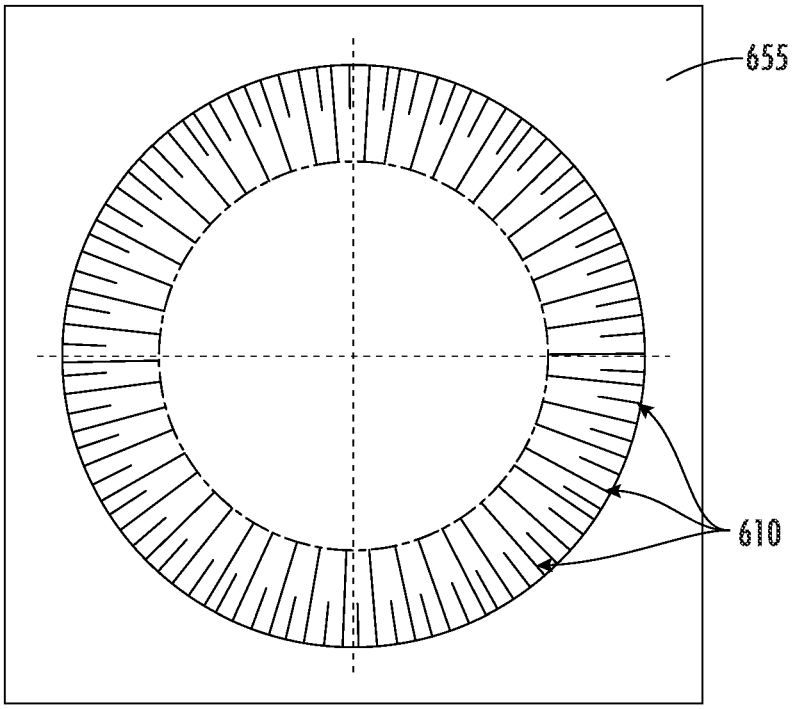
FIG. 7 illustrates a pre-embossment of a blank in accordance with some embodiments of the present disclosure.

Optionally, at a third station 330 the paper is then pre-embossed, pre-creased, or pre-stamped at an embossing station. In an embodiment, pre-embossing may serve to control the location, position, or number of wrinkles that form about the skirt. For example, pre-embossing may encourage the paper material to fold at particular locations in a more even distribution about the circumference of the skirt, resulting in a more uniform appearance to the skirt. In some embodiments, the pre-embossment comprises a series of lines 610 formed in a circular pattern. The lines 610 may be evenly spaced, in an embodiment. The lines 610 may have lengths that vary, in an embodiment. In a particular embodiment, the lines 610 may be straight, extending radially outward, and may alternate in length (see FIG. 6). In another embodiment, the lines 610 may extend about the circumference of the blank in a helical shape, or alternatively the lines 610 may take an oblique shape. In an embodiment, the pre-embossment is disposed in the location of the blank 655 which will become the skirt of the lid.

The paper may then advance to a cutting station, wherein discs (i.e. circles) are cut from the roll of paper. In some embodiments, a cutting device may be configured to cut the reel feed into a desired blank shape. In some embodiments, the blank 655 may be round, elliptical, square, rectangular, or other desired shape. In some embodiments, the cutting device may be a standalone device, while in other embodiments the cutting device may be integral with the deep draw device. For example, the lid formation assembly process 300 may have a fourth station 400 which cuts and also deep draws the disc, simultaneously or deep draw immediately following the cutting. In some embodiments, the blanks 655 may be precut, and a cutting device may not be necessary.

Figure 8:
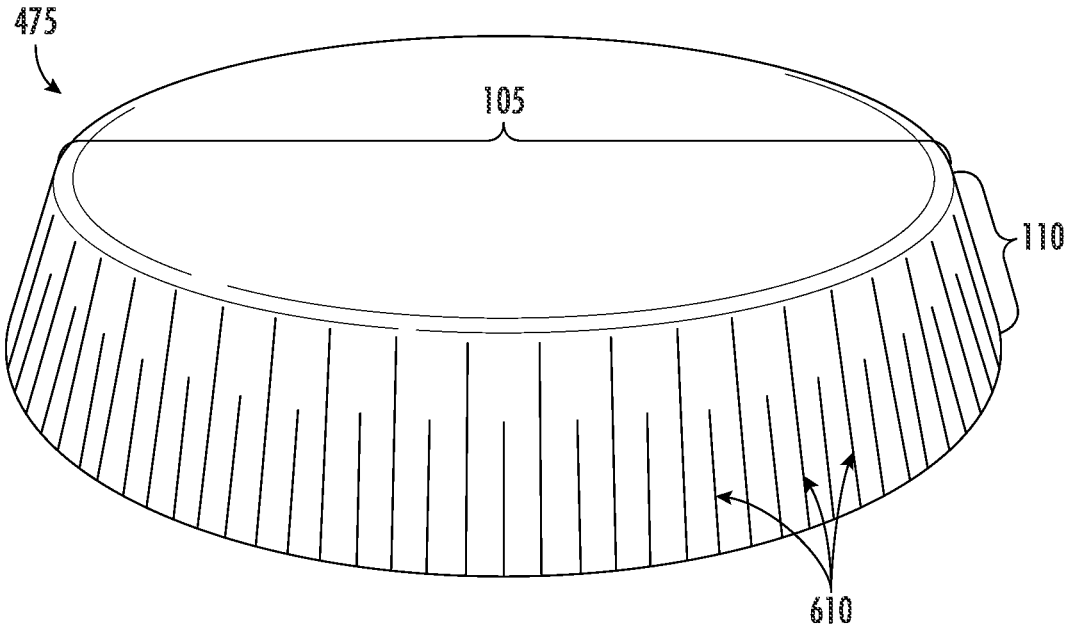
FIG. 8 illustrates a cup, in accordance with some embodiments of the present disclosure.

In an embodiment the blank 655 may advance to the fourth station 400. The fourth station may be a deep draw station wherein, the blank 655 is formed into a cup shape 475, as shown in FIG. 8. While a disc-shaped blank is described herein, the blank and resulting cup may have different shapes (i.e. a square blank may result in a cubic cup, etc.). As can be see, the pre-embossments 610 may be visible on the skirt 110 of the cup. The skirt portion 110 of the cup may extend downwardly from a base portion 105 of the cup 475, but may not be vertical or perpendicular to the base portion of the cup 475. In an embodiment, the skirt portion 110 of the cup 475 may have a diameter that varies from the upper portion thereof to the lower portion thereof, such that the skirt 110 is angled outwardly from a central axis of the cup 475.

Figure 9:
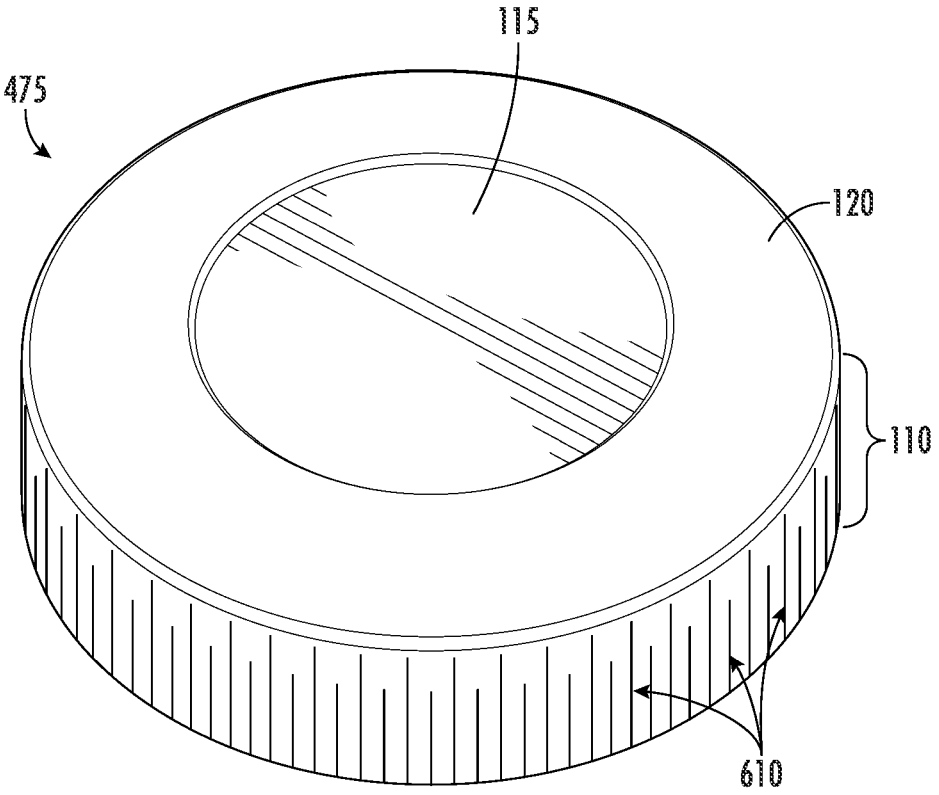
FIG. 9 illustrates a top perspective view of the cup, in accordance with some embodiments of the present disclosure.

In a next step, the formed cup 475 may be conveyed to an optional fifth station 335, for cover panel embossing. The cover panel embossing station 335 may emboss the base of the cup 475 in any manner known in the art. In one embodiment, the cover panel embossing station 335 may emboss a depression into the base of the cup 475. The embossment may provide strength, add rigidity, and/or allow flex of the formed lid. Optionally, the cover panel embossing station 335 may also compress the skirt of the cup inwardly such that the resulting embossed cup has a skirt that is vertical, closer to vertical, and/or perpendicular to (or close to perpendicular to) the base portion of the cup. This may be a pre-curling process. See FIG. 9.

Figure 10A:
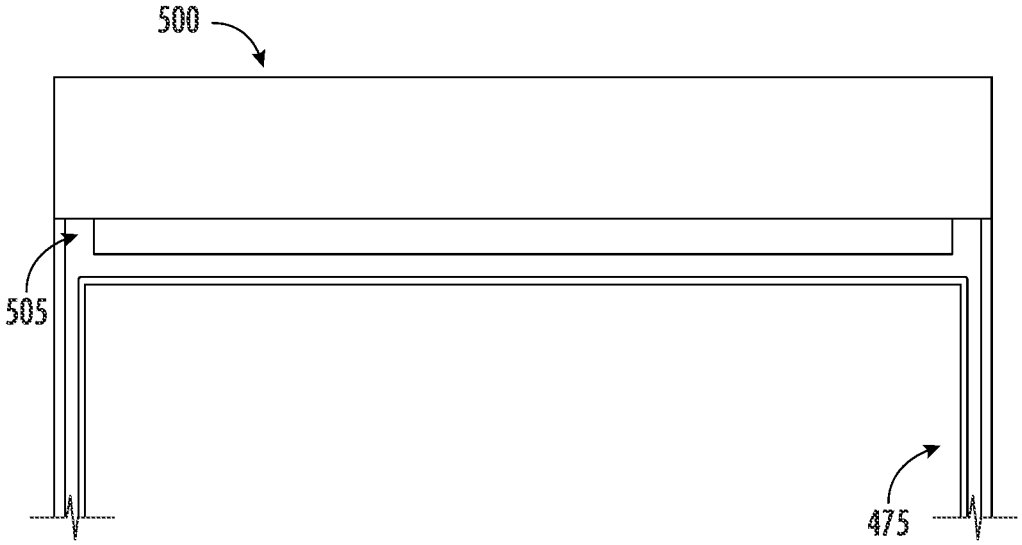
FIG. 10A illustrates a cross-sectional view of the cup in a beading station, for the purpose of forming a circumferential bead in the cup, in accordance with some embodiments of the present disclosure.
Figure 10B:
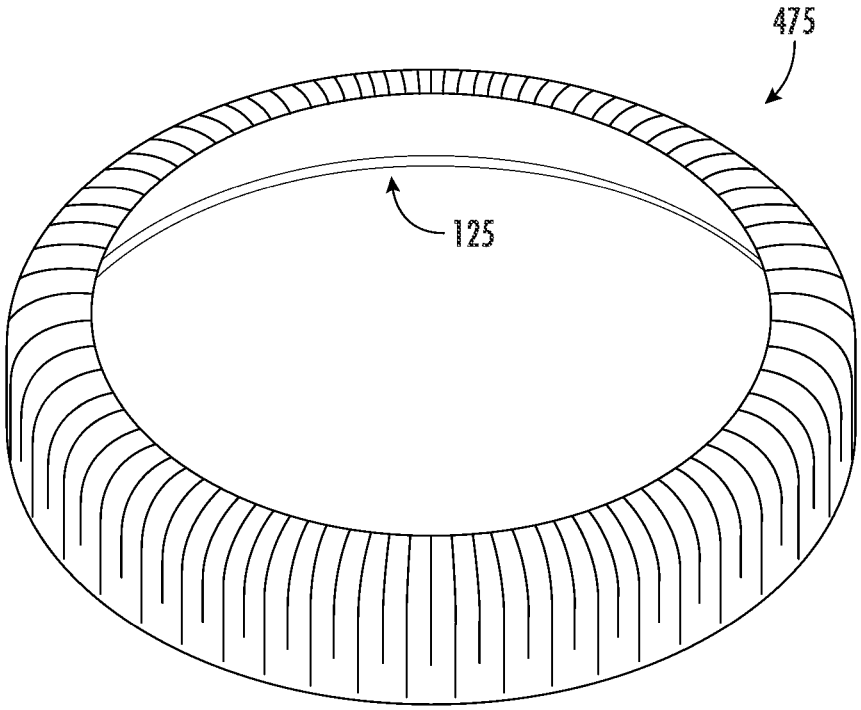
FIG. 10B illustrates a bottom view of the cup shape resulting from initial knurling and curling in accordance with some embodiments of the present disclosure.

Following embossment, the cup may optionally progress to a sixth station 340, for heating, wherein the cup is heated to a specified temperature to prepare the cup for forming steps that follow. In other embodiments, the heating station 340 and/or any heating element may be omitted from the process. For example, after heating, the cup may be conveyed to a seventh station 345 (see FIGS. 5, 10A). In the seventh station 345, the cup may be compressed into a mold 500 to form a circumferential bead between the base portion 120 and the skirt portion 110, as is discussed above (see arrow in FIG. 10B). The mold may comprise a pocket 505 which the paper is compressed into to form a bead. In connection with the bead formation, the seventh station may also be configured to begin to fold or curl the skirt inwardly, as can be seen in FIG. 10B.

Figure 11A:
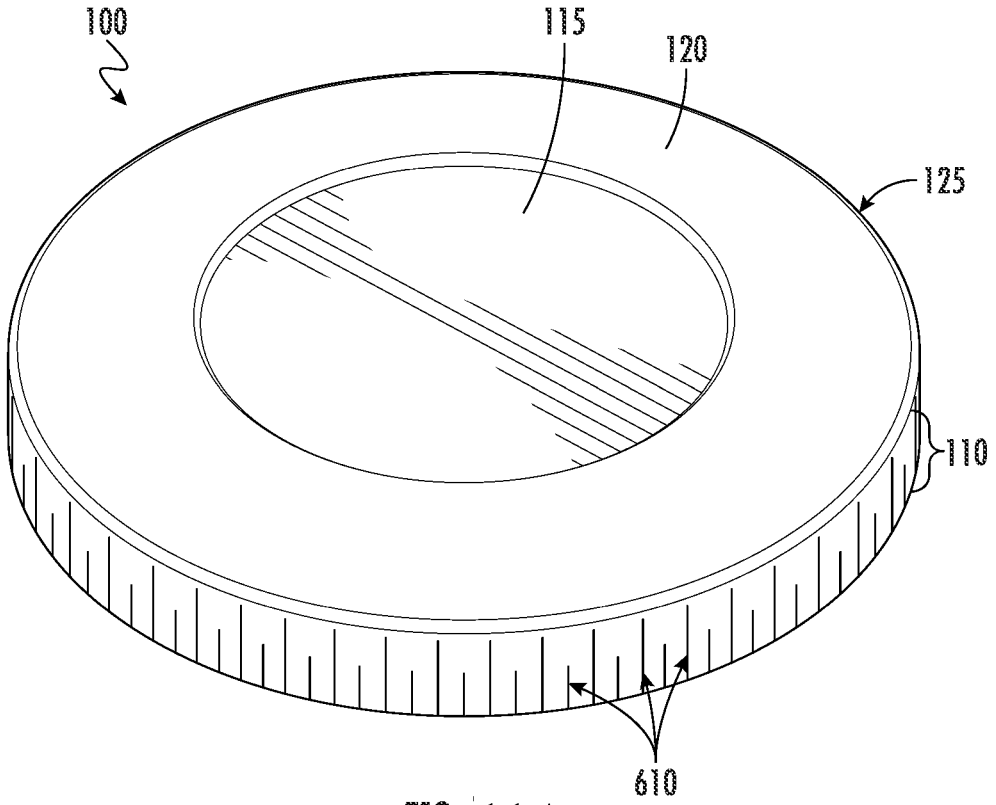
FIG. 11A illustrates a top perspective view of a lid in accordance with some embodiments of the present disclosure.
Figure 11B:
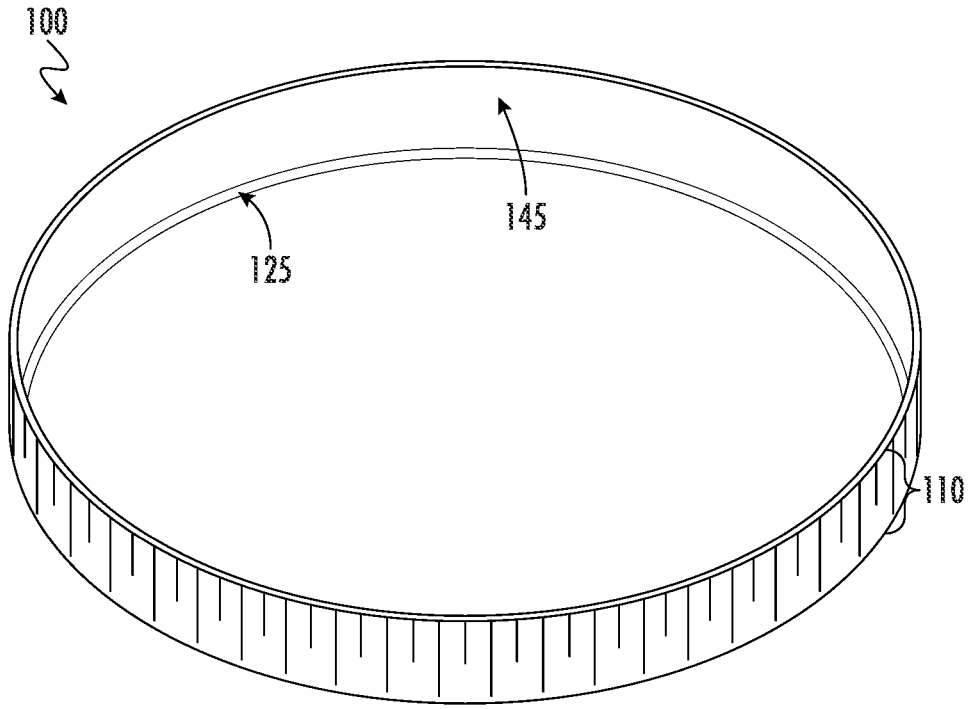
FIG. 11B illustrates a bottom perspective view of the lid in accordance with some embodiments of the present disclosure.
Figure 12:
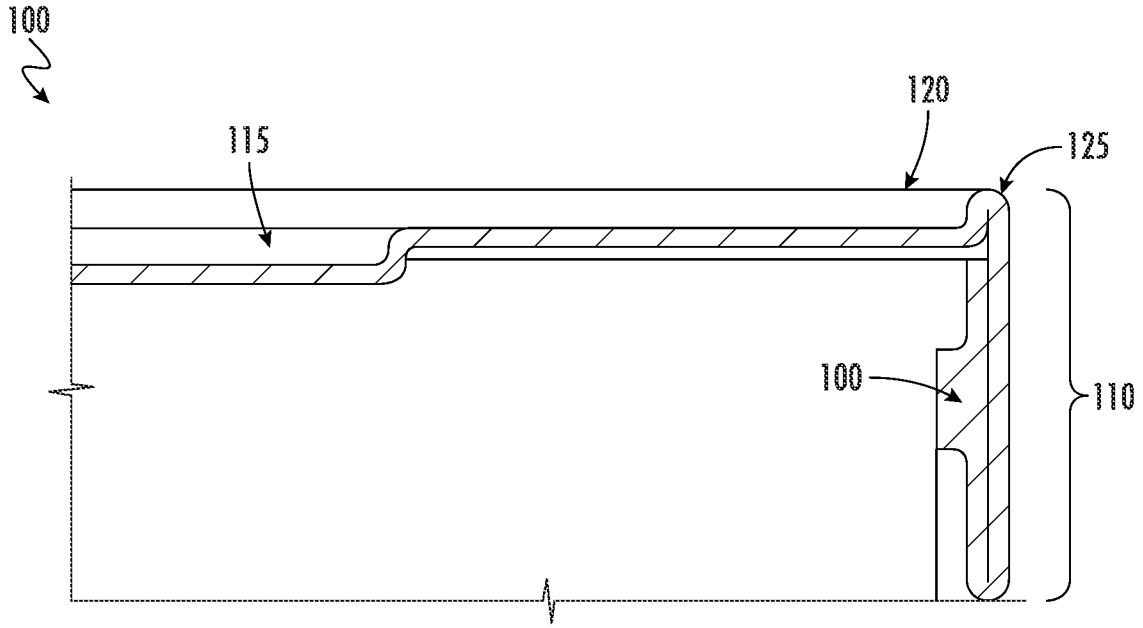
FIG. 12 illustrates a cross-sectional view of the overcap in accordance with some embodiments of the present disclosure.

The cup may then progress to a final station 350 for knurling/folding wherein the skirt of the cup is further folded or curled inwardly and compressed against itself. In the final station 350, the protrusion may be formed. To do so, the pressure applied above and/or below the protrusion may be greater than the pressure applied in the location of the protrusion. That is, the sidewalls of the skirt may be compressed against each other with more force above and below the protrusion (see FIGS. 11A and 11B). In the station 350, pressure may be exerted laterally, wherein the skirt is compressed between two chucks or other tools. In some embodiments, the pressure exerted below the protrusion may be greater or less than the pressure exerted above the protrusion. That is, equal pressure may not be applied both above and below the protrusion. Using a higher pressure above and/or below the protrusion may provide a stiffer, more robust skirt and lessen or avoid stretching of the lid over multiple uses or during humidity changes. A cross-section of an exemplary lid formed according to the process discussed herein is shown in FIGS. 1D, 12. In an embodiment, the system (i.e. the blank holder, drawing punch, and/or the knurling/folding tool) compress not just the wrinkles about the skirt, but actually compress the fibers within the paper, resulting in a stronger, more rigid product.

In an embodiment, the lids of the invention may have dimensions from about 50 mm to 100 mm, but should not be so limited. Advantageously, the methods of the invention may provide lids having stronger skirts, harder skirts, fewer visible wrinkles, a more aesthetically pleasing appearance, or the like. In an embodiment, the methods of the invention may provide skirts actually having more wrinkles than a conventional lid, but the wrinkles may be less visible, smoother, thinner, and/or more compressed into the sidewall of the skirt. The depth of the wrinkles in the inventive lids may be less than those of traditional paper lids.

The lids of the invention may be able to withstand multi-use applications, such as removal and reapplication to a container, over a rim, at least fifty (50) times. The lids of the invention may retain their shape and fit through humidity and temperature changes. In an embodiment, at ambient conditions, a lid was applied to a container and removed from the container until the lid was no longer secure about the rim of the container after application (e.g., the lid fell off when turned upside down).

In an embodiment, the lid will retain the properties (e.g., inner diameter, protrusion diameter, circumferential bead height) at ambient conditions, for example 20° C., and 30% relative humidity, the lid will retain a seal about the rim of the container. In some embodiments, the lid will retain the properties in humidity of up to 60%, up to 75% and even up to 85% relative humidity. In some embodiments, although the opening force, (e.g., the force needed to remove the lid from the container) may be reduced in higher humidity, the circumferential bead may provide a seal such that the lid and container remain engaged. Thus, the circumferential bead retains the lid on the container at high humidity levels.

What is claimed is:

1. A one-piece paper lid comprising:

a base having a central portion and peripheral portion;

a circumferential bead extending from the peripheral portion of the base, wherein the circumferential bead is radially extendable between an inward position and an outward position; and a skirt extending downward from the circumferential bead, the skirt comprising:

an outer sidewall;

an inner sidewall; and an upwardly extending curl connecting the outer sidewall and the inner sidewall, wherein the outer sidewall is linear between the upwardly extending curl and the circumferential bead, wherein the inner sidewall comprises an inner protrusion extending radially inward, wherein when circumferential bead is in the inward position the skirt defines a first diameter, and when the circumferential bead is in the outward position the skirt defines a second diameter, and wherein the circumferential bead is configured to extend into the outward position upon application of the lid to a container.

2. The one-piece paper lid of claim 1, wherein the circumferential bead is biased to the inward position.

3. The one-piece lid of claim 1, wherein the circumferential bead defines a height above the base, and wherein when the circumferential bead is radially extended to the outward position the height of the circumferential bead decreases between 20-60%.

4. The one-piece lid of claim 3, wherein the height of the circumferential bead decreases by at least 20% when the circumferential bead is radially extended to the outward position.

5. The one-piece lid of claim 3, wherein the height of the circumferential bead decreases by 40% when the circumferential bead is radially extended to the outward position.

6. The one-piece lid of claim 1, wherein when the circumferential bead is in the outward position the skirt defines a degree of flex of less than 3%.

7. The one-piece paper lid of claim 1, wherein the circumferential bead defines a cross-section of a half-cylinder in the inward position.

8. The one-piece lid of claim 1, wherein the inner protrusion is continuous about the inner sidewall of the skirt.

9. The one-piece lid of claim 1, wherein the skirt defines an upper portion comprising extending between the circumferential bead and the inner protrusion, and a lower portion extending between the upwardly extending curl and the inner protrusion, wherein the upper portion and the lower portion are configured with different flexion.

10. The one-piece lid of claim 9, wherein the upper portion exhibits a larger outward flex than the lower portion.

11. The one-piece lid of claim 9, wherein the lower portion is configured for minimal outward flex.

12. The one-piece lid of claim 9, wherein the flex between the upper portion and the lower portion is linear.

* * * * *